US005833287A

United States Patent [19]

Shade

[11] Patent Number: 5,833,287

[45] Date of Patent: Nov. 10, 1998

[54] VACUUM ASSEMBLY FOR RECOVERING AND DISPENSING FLOWABLE PACKAGING MATERIALS

[76] Inventor: Charles L. Shade, 430 Encinal Canyon Rd., Malibu, Calif. 90265

[21] Appl. No.: 728,596

[22] Filed: Oct. 10, 1996

[51] Int. Cl.[6] ..... A47L 5/24; B25J 15/06; B65B 1/16

[52] U.S. Cl. ..... 294/64.1; 15/344; 141/231; 406/38; 406/171

[58] Field of Search ..... 294/64.1, 64.2, 294/65; 15/257.1, 329, 330, 338, 344, 352; 43/139; 141/231, 286, 316, 390; 406/38, 105, 151, 153, 171, 172

[56] References Cited

U.S. PATENT DOCUMENTS

| | | | |
|---|---|---|---|
| 918,795 | 4/1909 | Thurman | 406/151 |
| 2,668,315 | 2/1954 | Crosby | 15/344 |
| 3,156,941 | 11/1964 | Tomaiuolo | 15/257.1 |
| 4,186,782 | 2/1980 | Scharf . | |
| 4,209,875 | 7/1980 | Pugh et al. | 15/344 |
| 4,527,824 | 7/1985 | Rosenfeld | 294/64.1 |
| 4,718,180 | 1/1988 | Johnson | 15/344 X |
| 4,780,986 | 11/1988 | Broomfield et al. | 15/352 X |
| 4,918,857 | 4/1990 | Wade et al. | 15/344 X |
| 5,088,860 | 2/1992 | Stockdale et al. . | |
| 5,096,337 | 3/1992 | Denton . | |
| 5,323,819 | 6/1994 | Shade . | |
| 5,375,293 | 12/1994 | Gilbertson | 15/352 X |
| 5,410,775 | 5/1995 | Frazier . | |

*Primary Examiner*—Johnny D. Cherry
*Attorney, Agent, or Firm*—Pretty, Schroeder & Poplawski

[57] ABSTRACT

A vacuum assembly for recovering and dispensing flowable packaging material is comprised of a chamber, an air pump, a screen, and a handle. The air pump, which may be an electric motor and squirrel cage blower, is stationed to pump air into the mouth, through the chamber, through the screen, and out an exhaust where the air may be useful for blowing flowable packaging material. The screen may be contoured or flat, and is configured to allow the passage of air but not the passage of flowable packaging material. The mouth opens to the exterior of the vacuum assembly, and is configured such that flowable packaging material that is contained within the chamber can fall out of the mouth, under the influence of gravity, when the mouth is oriented downward and the air pump is not pumping air. The chamber may increase in cross-sectional area from the mouth to the screen. A door, flap or other shutting mechanism may be used to shut the mouth. The chamber may be shaped to be seated in a container such that the vacuum assembly may be rested in a raised opening in the chamber.

17 Claims, 4 Drawing Sheets

FIG. 1
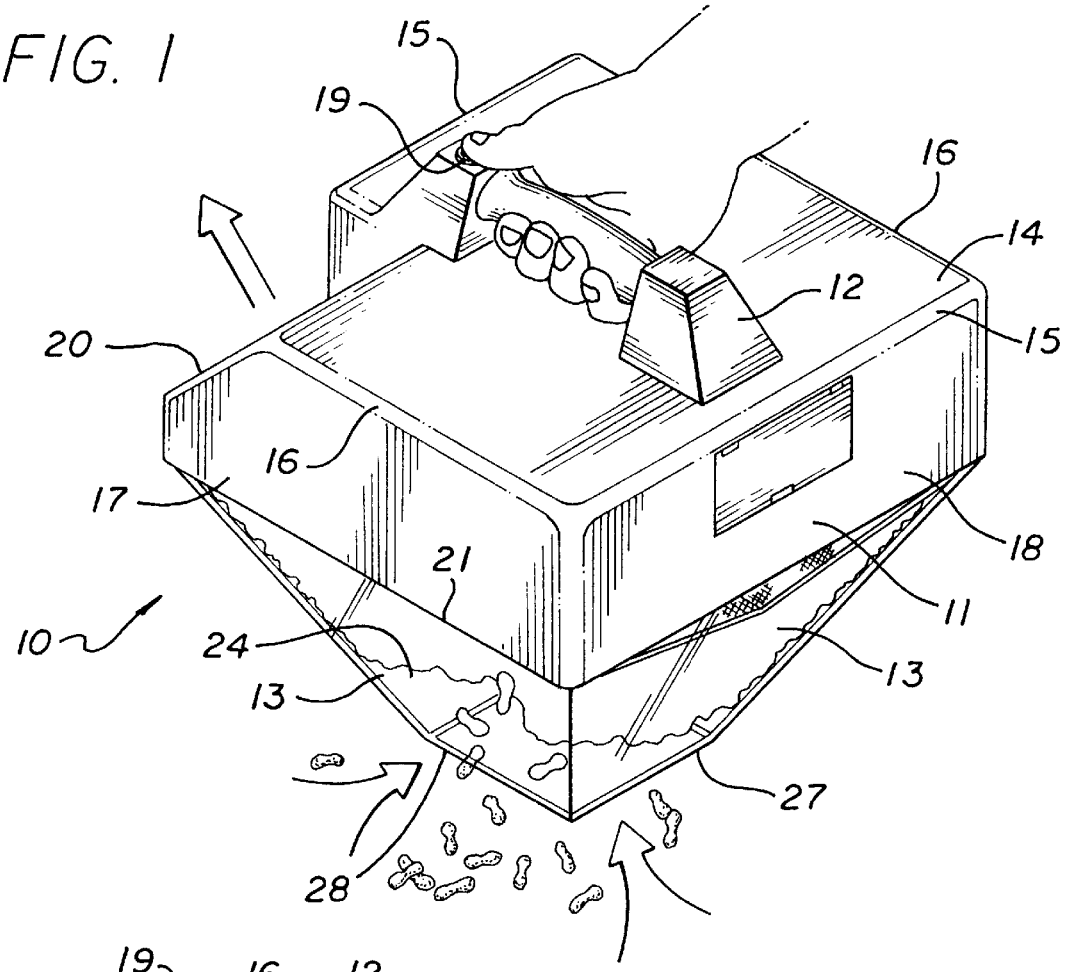
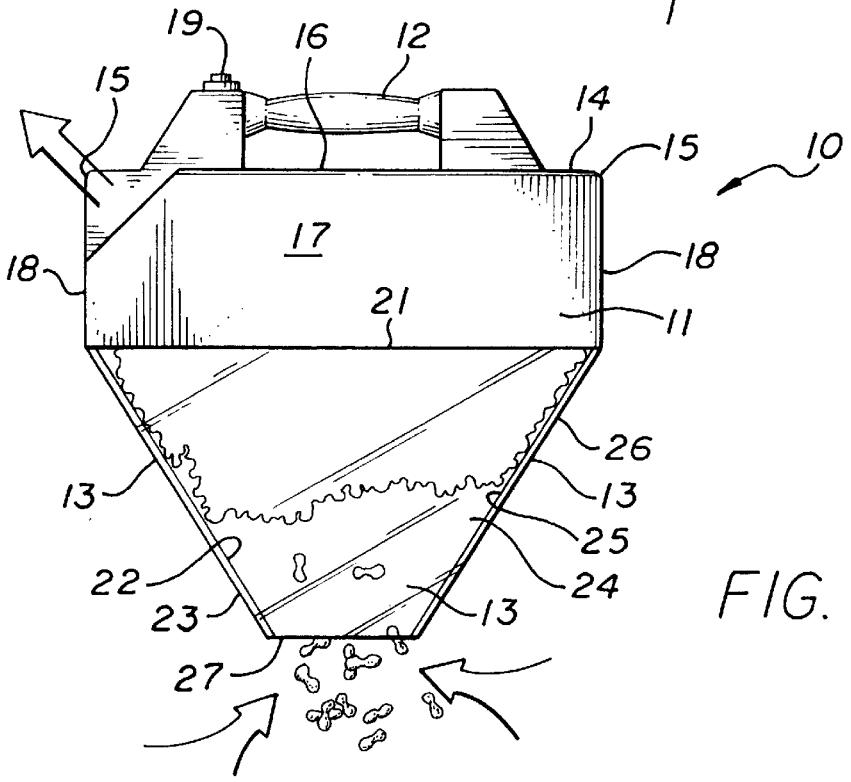
FIG. 2

VACUUM ASSEMBLY FOR RECOVERING AND DISPENSING FLOWABLE PACKAGING MATERIALS

BACKGROUND OF THE INVENTION

This invention relates generally to a system for recovering loose-fill materials and, more particularly, for the recovery and dispensing of flowable, packaging materials of the type used for protecting the contents of a container against damage. Additionally, this invention relates to a related method of recovering and dispensing flowable, packaging materials.

Flowable packaging materials are a form of dunnage which are now typically manufactured of expanded or extruded polystyrene or organic starch-based product in various preselected shapes, such as a figure "8" or an "S" shape. Many types of flowable packaging materials exist, including pellets made from various substances, shredded paper, and other goods suitable for packing objects of varying weights and sizes. The materials now in use are intended to provide readily flowable, lightweight dunnage of high volumetric efficiency and good strength in compression. The cost and ease of handling flowable packaging materials permit them to be used with great advantage over other types of packaging because an article to be protected within an outer container can very quickly be surrounded with an encompassing cushion of loose-fill, at very low added cost and with virtually no, or very low, shipping penalty.

Users of flowable packaging materials typically receive their materials in bulk, and supply the materials for use through either mass delivery systems or overhead hoppers at individual dispensing locations. End-users receiving flowable packaging materials with incoming packages must often deal with the mess of emptying the incoming packages of their contents as well as the cushioning loose-fill packaging material. Often these end-users also wish to reuse the packaging materials. Systems have been designed for end-users to handle these materials for receiving, storing and dispensing purposes at dedicated handling stations. To date, however, there has been little attention paid to the end-user who has material handling requirements at a multitude of locations or at varying locations, but does not have the need or resources to provide a large number of material handling units.

A portable device for the entrainment of ultra light loose-fill packing materials in an air stream to transport the packing materials into a depository for reuse or disposal is disclosed in U.S. Pat. No. 5,096,337. The device includes a transport duct with an inlet end portion, an outlet end portion, and a handle. A fan blade extends into the duct, and is covered by a screen that does not impede the flow of packing materials through the duct. A perforated shroud extends from the outlet, and is connected such that packing materials will pass through the shroud and into a collection bag while air passes out of the perforations in the shroud. While this device provides for the collection of packing material for possible reuse, it requires a packager to remove the collection bag and unload the packing material into a separate device.

An overhead vacuum assembly is disclosed in U.S. Pat. No. 5,323,819. The vacuum assembly includes an inlet end of a hose designed for the entry of flowable packaging material, the hose leading to an upper end of a storage bag. The lower end of the storage bag includes an opening with a dispensing valve for dispensing flowable packaging material. This system has numerous parts, and is bulky enough to make it reasonably expensive and cumbersome to transport.

U.S. Pat. No. 5,088,860 discloses an apparatus for gathering lightweight, low density objects. The device includes an annular plenum chamber directing pressurized air into a conduit in a downstream direction to create a vacuum. This device is useful only for gathering packing material for possible reuse, and not for reusing the material. This device, while it has wheels, is large and cumbersome to transport.

Accordingly, there has existed a definite need for a vacuum assembly for recovering and dispensing flowable packaging materials, providing clean and efficient handling of the materials to end-users having light material handling requirements at a multitude of locations or at varying locations. The present invention satisfies these and other needs, and provides further related advantages.

SUMMARY OF THE INVENTION

The present invention provides a vacuum assembly for recovering and dispensing flowable packaging materials. The vacuum assembly provides for clean and efficient handling of the materials at a multitude of locations. The vacuum assembly is of a small and simple design, thus minimizing the cost and maximizing the reliability. The invention also provides a vacuum assembly system for working with large quantities of flowable packaging materials.

The vacuum assembly includes a chamber with a mouth and a screen. The mouth opens to the exterior of the vacuum assembly. An air pump is stationed to pump air into the mouth, through the chamber, and out through the screen. The screen is configured to allow the passage of air, but not the passage of flowable packaging material. The air pump creates a negative air pressure in the chamber, with respect to atmospheric pressure, that is strong enough to draw flowable packaging material into the chamber by drawing it through the mouth.

A feature of the invention is that the mouth is configured such that flowable packaging material that is contained within the chamber will fall out of the mouth under the influence of gravity when the mouth is oriented downward with respect to the chamber, and the air pump is not pumping air. An advantage of this feature is that the flowable packaging material may be first recovered into and then readily dispensed from the chamber through the mouth. Recovery may be accomplished by placing the mouth close to flowable packaging materials, and activating the pump. The materials may be dispensed by holding the chamber with the mouth oriented down with respect to gravity, and shutting off the pump. This provides a fast, efficient and clean system for handling flowable packaging materials.

Another feature of the invention is that the chamber may increase in the cross-sectional area from the mouth to the screen. This configuration is advantageous in that pumped air will flow at a higher velocity near the mouth, where the cross-sectional area is lower. Thus, the vacuum assembly will have superior suction at the mouth, while the increasing cross-sectional area near the screen provides for greater capacity to hold flowable packaging material. An additional advantage of this feature is that the exterior of the vacuum assembly around the chamber may also demonstrate an increasing cross-sectional area from the mouth toward the screen. Thus, the vacuum assembly can be conveniently rested in an opening that is shaped to receive the exterior.

Another feature of the invention is that the screen, which may be flat, may instead be contoured to provide additional screen surface area. When the chamber is full of flowable packaging material, air flow through the chamber is limited to spaces between the flowable packaging material. When there is more screen surface area, there is more between-the-material space for the air to reach the screen, and thus more air can flow through the screen. The contoured screen, which is preferably V-shaped or conical, thus provides for less pressure loss by allowing more air to freely flow through the packaging material to the screen. As a result, the motor undergoes less strain in maintaining enough negative pressure to capture flowable packaging material, the motor uses less power for a given amount of flowable packaging material, and more flowable packaging material may be drawn into the chamber at a given power level.

The invention may also feature a transparent portion of the chamber. A person using the invention may thus advantageously view the remaining capacity of the invention for picking up flowable packaging material, or decide if the chamber contains enough flowable packaging material for a given use.

The invention may also feature batteries, which may be rechargeable, to power the motor. The batteries advantageously provide for portability and convenience in use.

An additional feature of the invention, which is useful in certain applications, is that the mouth may include a door, flap, or other shutting mechanism. Without the shutting mechanism, the mouth naturally opens to the exterior of the vacuum assembly. With the shutting mechanism, however, manual control must be exerted over the shutting mechanism so that the chamber opens to the exterior of the vacuum assembly. Therefore, the shutting mechanism, which may be spring loaded, is configured such that its actuation is manually controlled. Thus, when the air pump is not pumping air, the shutting mechanism can be manually controlled to a shut position for preventing flowable packaging material from passing out through the mouth, and it can be manually controlled to an open position for releasing the flowable packaging material through the mouth. Such mouth configurations may include covers designed to be manually removed, doors or flaps designed to be pushed or pulled by hand, and mechanical or electrical actuators designed to react to a convenient manual trigger.

The shutting mechanism is particularly advantageous in applications where the vacuum assembly is used to transport flowable packaging material to a destination more than a few feet away. After the flowable packaging material is drawn into the chamber, the shutting mechanism may be shut and the motor may be turned off to conserve energy. The shutting mechanism then retains the flowable packaging material in the chamber until the release of the packaging material is desired, at which time it is opened to release the packaging material. Yet another advantageous use for this feature is the unpacking and repacking of packages having smaller quantities of flowable packaging material. The flowable packaging material can be shut within the chamber and set aside, later to be released and reused as needed.

The invention may also feature a container for use with the vacuum assembly, thus creating a vacuum assembly system. The container is configured to receive flowable packaging material from the mouth. An advantage of this feature is that the vacuum assembly system is adaptable to both large and small packaging jobs. The container may be lightweight and portable, and thus useful for filling large, non-portable systems for dispensing flowable packaging material. Furthermore, the containers may be adapted from inexpensive off-the-shelf items, such as plastic garbage cans. A multitude of containers may be used, making the effective capacity of the vacuum assembly system virtually limitless. Thus, the use of a container compliments the vacuum assembly to make a vacuum assembly system.

An additional feature of this system is that the container may include an opening that conforms to the exterior of the vacuum assembly, such that the vacuum assembly may be supported upon the container while conformingly received in the opening. This feature is particularly advantageous for unpacking small packages, in that the vacuum assembly may be used to gather flowable packaging material, and then set upon the container, freeing users to empty the contents of the package while the flowable packaging material empties into the container.

The invention also features an optional chamber extension that includes a mouth adaptor to seal the chamber extension to the mouth, and a subordinate mouth. The subordinate mouth is configured so that flowable packaging material that is contained within the chamber can fall out of the subordinate mouth under the influence of gravity when the subordinate mouth is oriented downward with respect to the chamber. The essence of this feature is that it alters the effective chamber size and/or shape to adapt to specific applications. For example, the chamber can advantageously be made longer to reach into deep packages or to the floor. Likewise, it can be given an advantageously larger or smaller capacity, or better reach into narrow places. In a simple variation, it can be used to alter the mouth shape or size to provide for gentler, or more vigorous, suction. In other variations, the chamber or chamber extension may be flexible, allowing for flowable packaging material to be drawn into the chamber from around corners or underneath furnishings. This also provides for another mechanism of maintaining flowable packaging material within the chamber, in that the chamber or chamber extension may be flexed to direct the mouth upward, preventing the flowable packaging material contained within the chamber from falling out of the mouth or subordinate mouth under the influence of gravity.

Other features and advantages of the invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of a vacuum assembly embodying features of the present invention.

FIG. 2 is an elevational view of the vacuum assembly depicted in FIG. 1.

DESCRIPTION OF THE PREFERRED EMBODIMENTS

Figure 3:
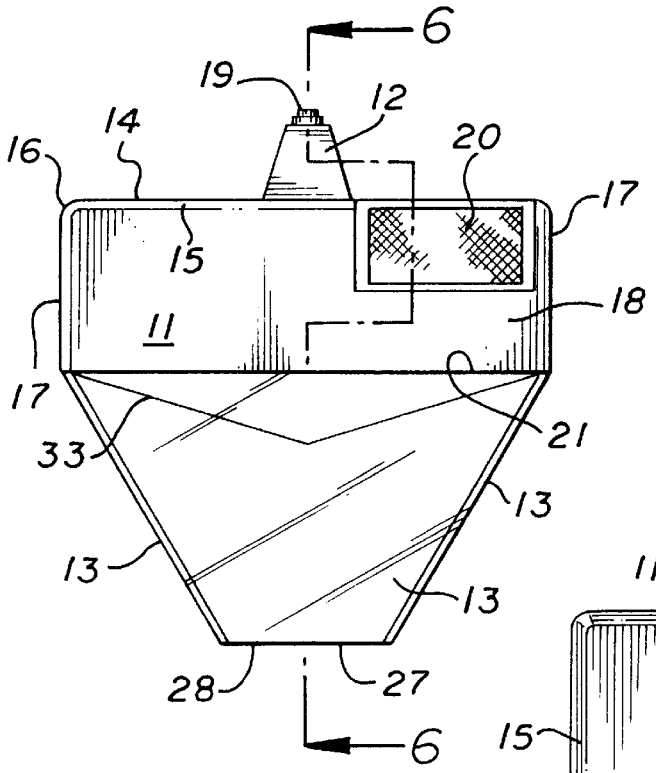
FIG. 3 is a side elevational view of the vacuum assembly depicted in FIG. 1.
Figure 4:
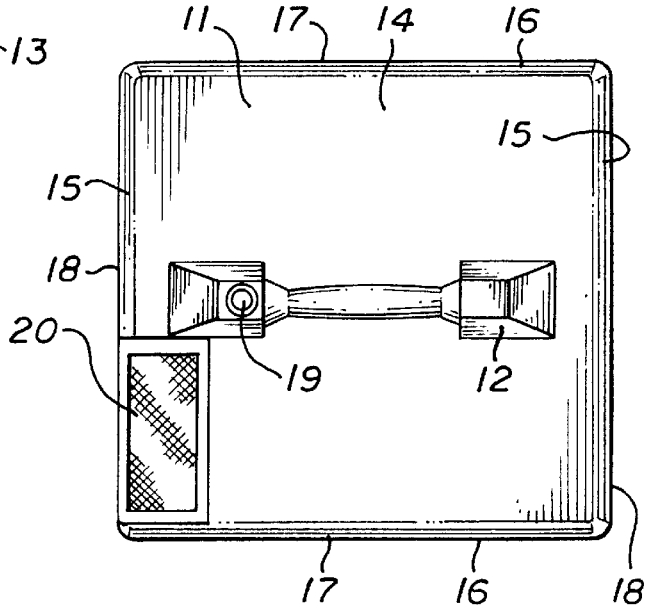
FIG. 4 is a plan view of the vacuum assembly depicted in FIG. 1.
Figure 5:
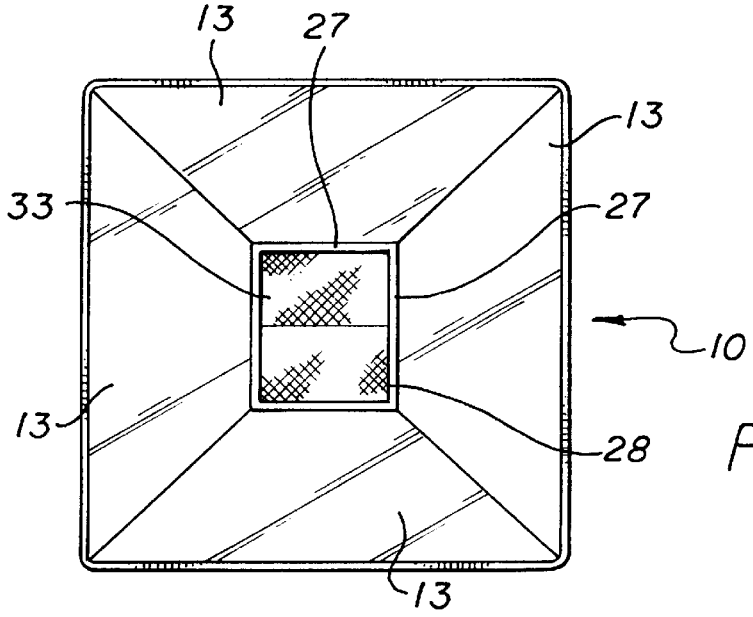
FIG. 5 is a bottom view of the vacuum assembly depicted in FIG. 1.

A vacuum assembly 10 according to the present invention is shown in FIG. 1. The vacuum assembly includes a housing 11, a handle 12, and four chamber walls 13.

With reference to FIGS. 1–5, the housing 11 includes a square top face 14 with two end edges 15 at opposite ends of the top face, and two side edges 16 at opposite sides of the top face.

The housing 11 has two side faces 17 adjacent the side edges 16 of the top face 14, and two end faces 18 adjacent the end edges 15 of the top face.

The handle 12 adjoins the top face 14, and is oriented parallel to the side edges 16 of the top face. This arrangement provides good control over the vacuum assembly 10 in rotation about axes parallel to the end edges 15 of the top face. The handle includes a switch 19 positioned on the handle such that a hand grasping the handle can actuate the switch with its thumb. Other possible switches include a trigger switch under the handle, positioned for the index finger.

An exhaust outlet 20 is preferably defined by an opening that straddles the top face end edge 15 that is closest to the switch 19. The exhaust outlet is preferably oriented to direct air to blow up and away from a user of the vacuum assembly 10.

Each of the four chamber walls 13 is adjacent to the housing 11 along a top edge 21 of the chamber wall, with two of the chamber walls each extending down from one of the end faces 18 and two of the chamber walls each extending down from one of the side faces 17. Each chamber wall has two surfaces, an inner surface 22, and an outer surface 23. Each chamber wall is also adjacent to two other chamber walls, forming a tube 24. The tube has an inner surface 25 that includes the inner surface of each chamber wall. The tube also has an outer surface 26 that includes the outer surface of each chamber wall. It will be appreciated that although the preferred tube includes four downwardly converging walls, other shapes of the tube may be advantageously employed.

Each chamber wall 13 has a bottom edge 27 on a side opposite its top edge 21. The bottom edges adjoin each other to form a mouth 28 leading to the inner surface 25 of the tube 24. The mouth defines an unobstructed opening large enough to allow the passage of flowable packaging material, the opening preferably being approximately a six inch by six inch square.

Figure 6:
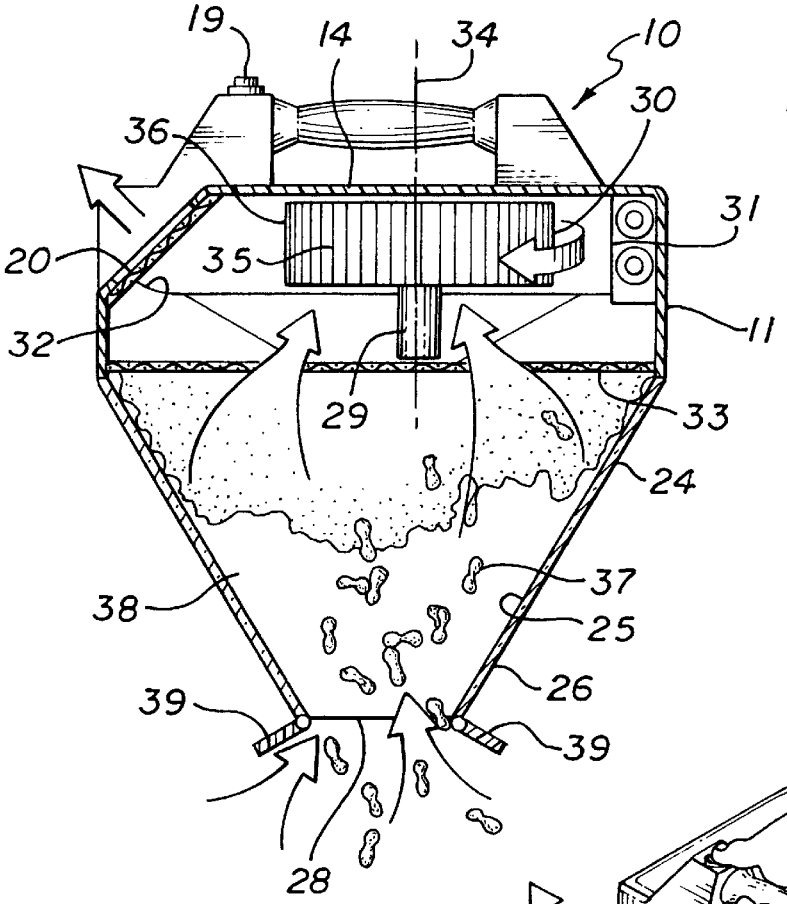
FIG. 6 is a cross-sectional elevational view of the vacuum assembly depicted in FIG. 1, now having flaps attached, taken along line 6—6 of FIG. 3 while the vacuum assembly is running.

With reference to FIG. 6, the housing 11 includes a motor 29, a fan 30, a battery compartment 31, walls defining an exhaust passage 32, and a screen 33.

The fan 30 is preferably of the "squirrel cage" variety, and may be stationed and suspended so as to be rotatable around an axis 34 normal to the top face 14 of the housing 11. The fan defines an inner cell 35 with a plurality of vanes 36 that surround the cell in a ring. The motor 29 is affixed in the housing, positioned to drive the fan around its axis of rotation. Greater motor strength and fan efficiency may be used for larger or heavier flowable packaging materials.

When the motor 29 rotates the fan 30, air is pumped from the inner cell 35 of the fan, through the vanes 36 to the exhaust passage 32. The exhaust passage is configured to direct air from the vanes to the exhaust outlet 20.

The screen 33 (also shown in FIGS. 3 & 5) is designed to freely allow the passage of air, but not the passage of flowable packaging material 37. The screen is configured and affixed to the rest of the housing 11 so as to prevent flowable packaging material from entering the inner cell 35 of the fan 30. The screen may be planar, V-shaped, conical, semi-spherical, or any other advantageous shape. Preferably, the screen is designed to maximize its surface area and minimize manufacturing costs.

A chamber 38 is defined by the inner surface 25 of the tube 24, the screen 33 and a small portion of the housing 11. The chamber is essentially airtight except for the mouth 28 and the screen. The tube may be made from a transparent material so that the flowable packaging material 37 contained within the chamber is visible.

The tube inner surface 25 of the vacuum assembly 10 increases in cross-sectional area from the mouth 28 to the screen 33. The tube outer surface 26 cross-sectional area increases similarly in a direction from the mouth toward the screen. While the chamber may be in a broad array of advantageous sizes, preferably it has a volume approximately between ¼ and ⅓ cubic feet.

The vacuum assembly 10 preferably has a battery compartment 31 for battery powered operation, but may advantageously be run off of other power sources, such as alternating current provided through a line cord.

In operation, the vacuum assembly 10 may be used to transport flowable packaging material 37 from one location to another. The vacuum assembly is held with its mouth 28 near the flowable packaging material. The switch 19 is triggered, activating the motor 29. The motor rotates the fan 30, which pumps air from its inner cell 35 through the vanes 36, then passing through the exhaust passage 32 to be exhausted from the exhaust outlet 20.

The pumping action of the fan 30 produces a negative pressure (with respect to atmospheric pressure) in the inner cell 35, drawing air through the screen 33. The air drawn though the screen creates a negative pressure in the chamber 38, thus drawing air into the chamber through the mouth 28. Because the tube inner surface's 25 cross-sectional area is smaller near the mouth, the air flow velocity is greater near the mouth.

Flowable packaging material 37 is drawn through the mouth 28 into the chamber 38 along with the air. The flowable packaging material is stopped by the screen 33 while the air continues to pass through and into the fan inner cell 35. The pumped air thus causes a quantity of flowable packaging material to be drawn into and held within the vacuum assembly 10. The screen, having a large surface area, allows efficient air flow even as the chamber fills with flowable packaging material.

When the flowable packaging material 37 is within the chamber 38, the vacuum assembly 10 can be moved to a second location. During the movement, the flowable packaging material may be maintained within the chamber by any of a variety of methods. For example, the motor 29 may be kept on to sustain the negative pressure in the chamber, the mouth 28 may be shut, such as with manually controlled doors or flaps 39, or the chamber may be oriented with the mouth directed upward relative to the chamber such that gravity prevents the flowable packaging material from falling out of the chamber through the mouth. Note that in FIG. 6 the flaps are configured to be manually grasp from the side and pulled open or pushed shut.

At the second location, the flowable packaging material 37 may be released from the chamber 38. Depending on the method of maintaining the flowable packaging material within the chamber, the flowable packaging material may be released by orienting the vacuum assembly 10 such that the mouth is directed downward, stopping the fan 30 so that there is no longer a negative pressure within the chamber, and/or opening or removing the door or flap 39. The flowable packaging material thus falls out of the chamber through the mouth under the influence of gravity.

In an extension of the above-described method, the vacuum assembly 10 may be used for cleanup operations around packaging stations. In particular, the air exhausting from the exhaust outlet may be directed to blow flowable packaging material 37 from under objects, and toward a common location. Once the flowable packaging material is blown to a convenient location, the vacuum assembly is used in the above-described manner to transport the flowable packaging material for disposal or reuse. To further advance this cleanup function, the exhaust outlet 20 and exhaust passage 32 may preferably be configured to create a strong blast of directed air at an angle approximately 40° up from the plane of the top face 14.

Figure 7:
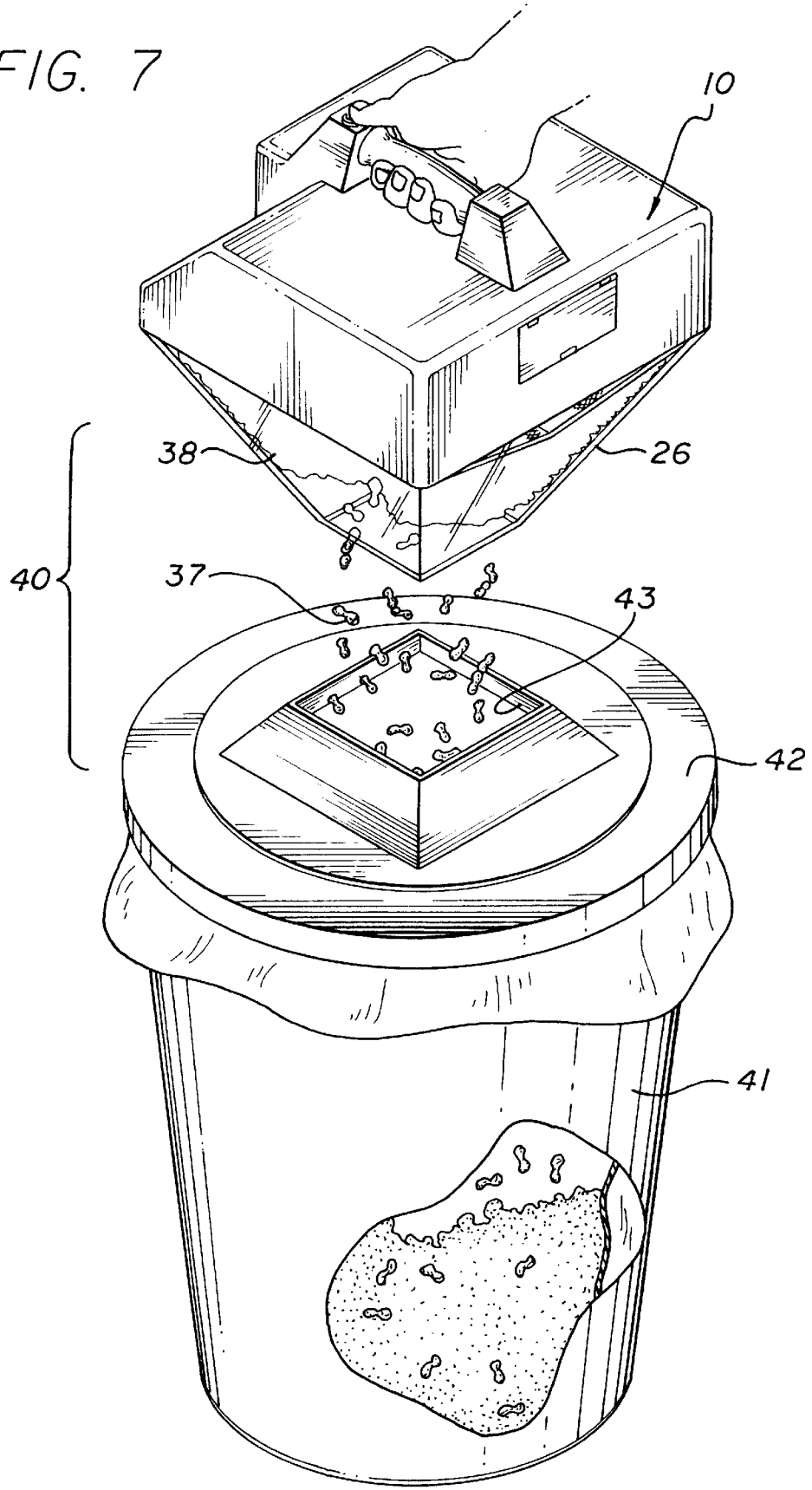
FIG. 7 is a perspective view of a vacuum assembly system embodying features of the present invention.

A vacuum assembly system 40 according to the present invention is shown in FIG. 7. The system includes the above described vacuum assembly, and further includes a container 41 with a lid 42 having an opening 43 to permit filling the container with flowable packaging material 37.

Preferably, the opening 43 is raised, and conforms to the cross-sectional shape of the tube outer surface 26. The opening is sized to receive the outer surface of the tube, allowing the vacuum assembly 10 to be supported upon the container 41 while conformingly received in the opening. The opening is raised to provide additional strength to the lid 42, and to allow for additional room under the lid for a pile of flowable packaging material 37.

The system 40 is used by following the above method for transporting flowable packaging material 37 from one location to another, wherein the second location is the container 41. In using the system, the vacuum assembly is received in the opening 43 prior to the flowable packaging material leaving the chamber 38. The conforming fit between the tube outer surface 26 and the opening prevents loss of flowable packaging material from the container. Furthermore, the vacuum assembly 10 may be set upon the edges of the opening 43 in the lid 42, for convenient storage while not being used (such as when a package's primary contents are being removed).

The system 40 may be further used by removing the lid 42 from the container 41, and using the vacuum assembly 10 to transport flowable packaging material 37 from the container to another package in preparation for shipping that package.

Figure 8:
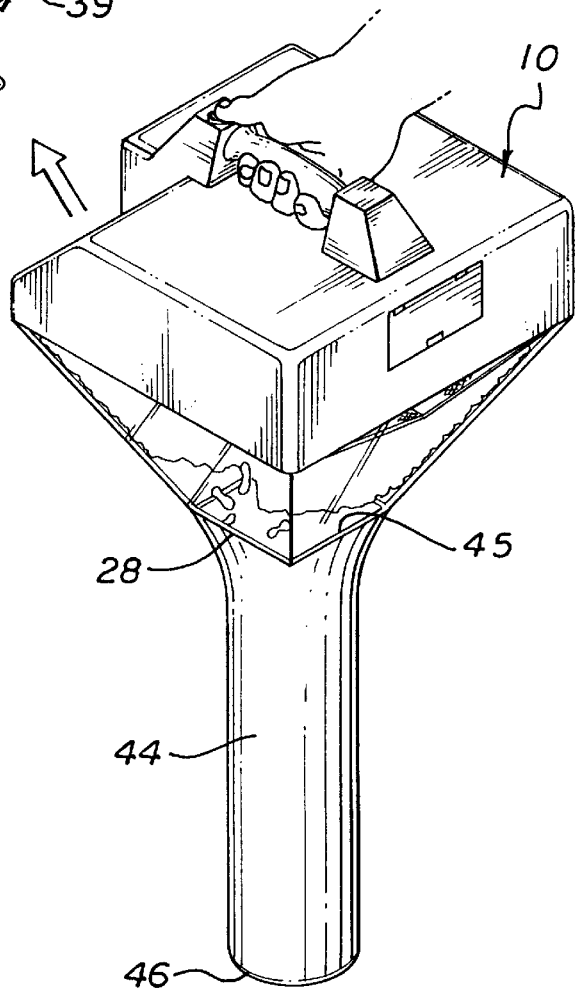
FIG. 8 is a perspective view of the vacuum assembly depicted in FIG. 1, further including a chamber extension.

With reference to FIG. 8, the vacuum assembly 10 may be further enhanced with the addition of a chamber extension 44. The chamber extension preferably is tube-shaped, having a mouth adaptor 45 that seals the chamber extension to the mouth 28, and a subordinate mouth 46. The chamber extension extends the effective capacity and length of the chamber to form an extended chamber, with the subordinate mouth serving as the mouth to the extended chamber. Thus, the subordinate mouth is configured such that flowable packaging material that is contained within the chamber can fall out of the subordinate mouth under the influence of gravity when the subordinate mouth is oriented downward with respect to the chamber. Such an arrangement is particularly useful for use with deep packages, or packages having large amounts of flowable packaging material. It is also useful for picking flowable packaging materials up from the floor.

From the foregoing, it will be appreciated that the present invention provides a vacuum assembly for recovering and dispensing loose-fill materials. The materials are cleanly and efficiently handled, and the vacuum assembly is portably usable at a multitude of locations. The small and simple apparatus has a low cost and is reliable. The invention also provides for working with large quantities of flowable packaging materials by providing a vacuum assembly system.

While a particular form of the invention has been illustrated and described, it will be apparent that various modifications can be made without departing from the spirit and scope of the invention. For example, while a squirrel cage fan drawing air through the screen was described, pancake fans, paddle wheel fans, and other air pumps, including those that could be located between the screen and the mouth, are within the scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

I claim:

1. A vacuum assembly for recovering and dispensing flowable packaging materials, comprising:

a chamber including a mouth and a screen, wherein said mouth has an opening that opens to the exterior of the vacuum assembly, the opening being sufficiently large to permit flowable packaging materials to pass through the opening into a portion of the chamber between the mouth opening and the screen; and an air pump stationed to pump air through said chamber such that during operation of said air pump the pumped air first flows into said mouth and then flows through said screen;

wherein said screen is configured to allow the passage of air but not the passage of flowable packaging material, and said mouth and said portion of the chamber are configured such that flowable packaging materials contained within said chamber fall out through said mouth opening under the influence of gravity when said mouth is oriented downward with respect to said chamber and said air pump is not pumping air; and wherein said screen is fixed relative to said mouth during the recovering and dispensing operations.

2. The vacuum assembly of claim 1, wherein said chamber is formed from a wall that tapers outwardly between said mouth opening and said screen such that substantially all of the flowable packaging materials contained within the chamber fall out through said mouth opening under the influence of gravity when said mouth is oriented downward with respect to said chamber and said air pump is not pumping air.

3. The vacuum assembly of claim 1, wherein said chamber includes a transparent portion.

4. The vacuum assembly of claim 1, wherein said screen is a shape selected from the group of flat, conical, V-shaped and semi-spherical.

5. The vacuum assembly of claim 1, wherein said air pump comprises a fan and an electric motor.

6. The vacuum assembly of claim 5, wherein said fan is a squirrel cage blower.

7. The vacuum assembly of claim 5, wherein said electric motor is configured to be powered by a battery.

8. The vacuum assembly of claim 1, further comprising a handle, a switch, and an exhaust passage, wherein the switch activates said air pump, and is located on the vacuum assembly such that it may be activated by a hand that is holding said handle, and wherein said exhaust passage directs air out of an exhaust outlet such that the air tends to blow up and away from the person holding the handle.

9. The vacuum assembly of claim 8, wherein:

said chamber increases in cross-sectional area from said mouth to said screen;

said chamber includes a transparent portion;

said screen is a shape selected from the group of flat, conical, V-shaped and semi-spherical;

said air pump comprises a fan and an electric motor that is configured to be powered by a battery; and said fan is a squirrel cage blower.

10. The vacuum assembly of claim 1, further comprising a shutting mechanism that has a shut position to prevent flowable packaging material from passing through said mouth and an open position spaced from the shut position such that, while said air pump is not pumping air, flowable packaging material that is contained within said chamber can fall out of said mouth under the influence of gravity, wherein said shutting mechanism is configured to be actuated upon manual control.

11. The vacuum assembly of claim 10, wherein said chamber increases in cross-sectional area from said mouth to said screen.

12. The vacuum assembly of claim 1, further comprising a chamber extension including a mouth adaptor that seals said chamber extension to said mouth, and a subordinate mouth, wherein said subordinate mouth is configured such that flowable packaging material that is contained within said chamber can fall out of said subordinate mouth under the influence of gravity when said subordinate mouth is oriented downward with respect to said chamber.

13. A vacuum assembly system for recovering and dispensing flowable packaging materials, comprising:

a chamber including a mouth and a screen, wherein said mouth opens to the exterior of the vacuum assembly; and an air pump stationed to pump air through said chamber such that during operation of said air pump the pumped air first flows into said mouth and then flows through said screen;

wherein said screen is configured to allow the passage of air but not the passage of flowable packaging material, and said mouth is configured such that flowable packaging material contained within said chamber can fall out of said mouth under the influence of gravity when said mouth is oriented downward with respect to said chamber and said air pump is not pumping air;

and a container having a cover with an opening that is configured to receive flowable packaging material from said mouth;

wherein said container cover opening conforms to the exterior of said chamber such that the chamber may be conformingly received in the opening with said mouth inside of said container, and oriented downward with respect to said chamber; and wherein the exterior of the chamber increases in cross-sectional area from said mouth to said screen, allowing said chamber to be supported upon said container cover while conformingly received in the opening.

14. A method for transferring flowable packaging material from a first location to a container, comprising:

using negative air pressure within a chamber to draw the flowable packaging material at the first location through a chamber mouth and into the chamber;

moving the chamber to a second location above the container while maintaining the flowable packaging material within the chamber; and dropping the flowable packaging material that is contained within said chamber out of said chamber through said mouth under the influence of gravity into the container.

15. The method of claim 14, wherein the flowable packaging material is maintained in the chamber by sustaining the negative air pressure in the chamber.

16. The method of claim 14, wherein the flowable packaging material is maintained in the chamber by shutting the mouth.

17. The method of claim 14, wherein the flowable packaging material is maintained in the chamber by orienting the chamber such that the mouth is upward with respect to the chamber.

* * * * *